United States Patent [19]

Roque

[11] 3,985,167

[45] Oct. 12, 1976

[54] ROTATABLE DUAL HOSE ASSEMBLY

[75] Inventor: Perry Roque, Pacifica, Calif.

[73] Assignee: Lawrence Peska Associates, Inc., New York, N.Y. ; a part interest

[22] Filed: Oct. 23, 1975

[21] Appl. No.: 624,752

[52] U.S. Cl. ..... 141/392; 285/136; 285/137 R

[51] Int. Cl.[2] ..... B65B 1/04

[58] Field of Search..... 285/168, 272, 136, 137 R; 141/384, 383, 385, 386, 89, 285, 290, 392; 251/153; 137/580

[56] References Cited

UNITED STATES PATENTS

| | | | |
|---|---|---|---|
| 2,412,287 | 12/1946 | Phillips | 285/168 X |
| 2,745,682 | 5/1956 | Chevallier | 285/168 X |

*Primary Examiner*—Richard E. Aegerter
*Assistant Examiner*—Michael H. Thaler

[57] ABSTRACT

A dual hose arrangement for independently conveying two respective fluids is made rotatable, through unlimited 360° excursions, at a situs near the ends of the hoses, in order to preclude twisting or kinking of the hoses when the end portions, which may include a multi-outlet nozzle, are handled. A first of the hoses contains a conventional swivel connection, permitting the end portion of the hose to be rotated without limitation. A fluid-tight box is mounted around the first hose, enclosing the swivel connection. The second hose is interrupted and terminated at ends of the box on opposite sides of the swivel connection so that the box couples the interrupted ends of the second hose and provides a conduit for the fluid carried by the second hose. The end of the box adjacent the ends of the hoses is rotatable with respect to the rest of the box so that when the ends of the hoses are twisted, the rotatable end of the box and the end of the first hose will rotate together about the axis of the first hose and the end of the second hose will rotate about the first hose. The arrangement is particularly suitable for use at the nozzle end of a gasoline hose which is paralleled by a second, vapor recovery hose.

5 Claims, 2 Drawing Figures

ROTATABLE DUAL HOSE ASSEMBLY

FIELD OF INVENTION

This invention relates to hoses or tubes, particularly to paralleled hoses which have a rotatable connection included therein.

PRIOR ART

In a hose which is terminated in a nozzle, such as a gasoline pump hose, handling of the nozzle tends to twist the hose. Such twisting of a single hose is rarely troublesome. If necessary it can easily be reduced or eliminated by turning the hose in a direction opposite to that in which it is twisted.

Recently dual, paralleled hoses have come into use at gasoline stations, one hose being used to convey gasoline and the second, paralleled hose being a suction hose to recover gasoline vapors created during exposure of gasoline to the ambient atmosphere. (The second, vapor recovery hose is provided to reduce the amount of hydrocarbon vapors introduced into the atmosphere, thereby to reduce pollution.)

Dual hoses, however, are more susceptible to problems since when their nozzle is twisted, the hoses tend to kink and snarl about each other. Reducing the kinks and snarls is usually for more difficult than simply untwisting the hoses.

Heretofore there were no means available to preclude twisting, kinking, or snarling of a dual hose assembly. Accordingly the elimination of this problem is one object of the present invention. Other objects are the provision of a rotatable dual hose assembly and the provision of a novel rotatable coupling for dual hoses. Further objects and advantages will become apparent from a consideration of the ensuing description.

DRAWINGS

Figure 1:
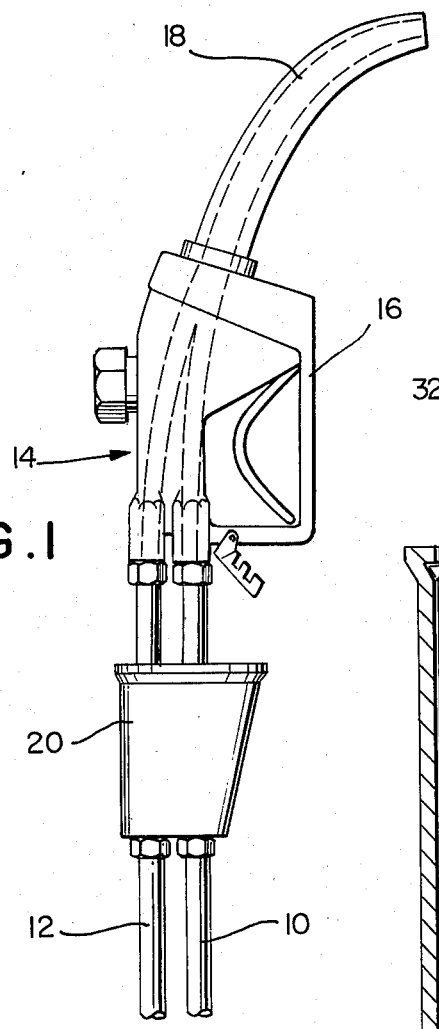
Figure 2:
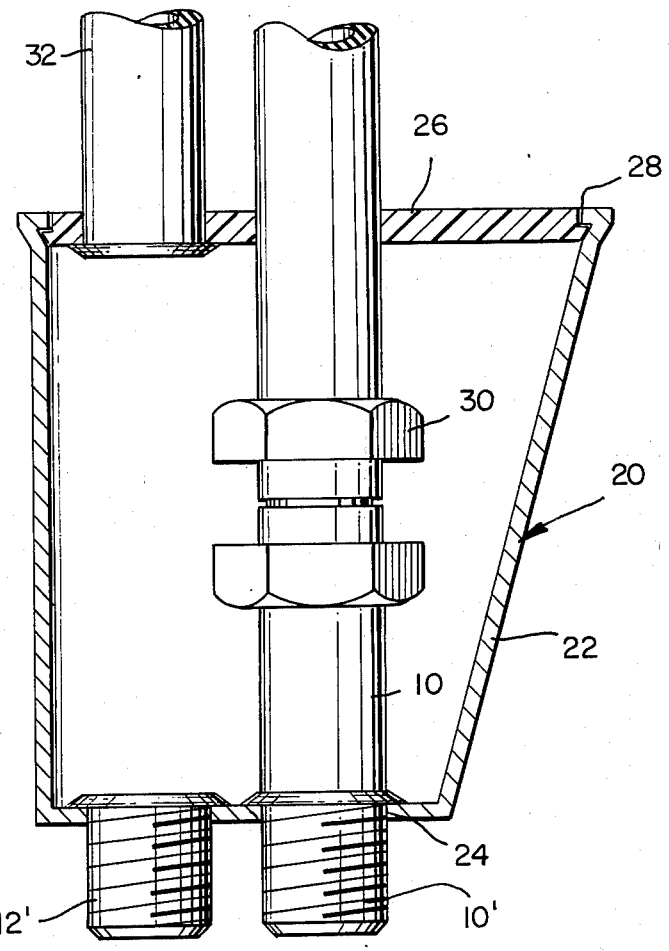

FIG. 1 is a view of a dual hose assembly of the invention and FIG. 2 is a close-up, sectional view of the rotatable coupling of FIG. 1.

DESCRIPTION

A dual hose assembly comprises a gasoline hose 10 paralleled by a vapor return, suction hose 12. Hoses 10 and 12 are terminated in a nozzle 14 which includes a handle 16 and a hand-operated gasoline valve. A spout 18 includes an inner tube for dispensing gasoline supplied by hose 10 and a concentric outer tube for recovering vapor and routing it to suction hose 12. In use, handling of nozzle 14 often tends to kink or snarl hoses 10 and 12 together, and it is difficult to straighten the hoses.

To preclude such kinking or snarling, according to the invention a coupling 20 is provided which enables nozzle 14 and the adjacent portions of hoses 10 and 12 to rotate through unlimited turns with respect to the rest of hoses 10 and 12. Thereby handling and twisting of nozzle 14 will not be able to create any kinks, twists, or snarls in hoses 10 and 12.

Coupling 20 comprises an enclosure 22 which has two ends 24 and 26. End 24 is fixed and integral with the sides of enclosure 22 and the gasoline and vapor hoses are fixed to end 24 by means of respective couplings 10' and 12'. End 26 is circular and rotatable with respect to the rest of enclosure 22. The edge 28 of end 26 has a complex shape which interfits with the ends of the walls of enclosure 22 such that the two parts are held together mechanically, form a substantially vapor tight seal, yet still can rotate with respect to each other. End 24 may have a generally oval shape with enclosure 22 tapering from an oval to a circular shape from end 24 to end 26.

Hose 10 includes a swivel connection 30 inside enclosure 22 which permits the portion of hose 10 on one side of connection 30 to be rotated with respect to the portion of hose 10 on the other side of connection 30. Hose 10 passes through end 26 of enclosure 22 and is fixed to end 26 by a mechanically rigid and vapor tight connection.

Vapor hose 12 is interrupted so that the ends are terminated with and communicate into enclosure 22, whereby enclosure 22 interconnects and couples the respective portions of hose 12. The bottom end of hose 12 (not shown in FIG. 2) is fixed to bottom end 24 of enclosure 22 by means of coupling 12'. The top end 32 of hose 12 is rigidly terminated in rotatable end 26.

OPERATION

In use, when nozzle 14 is handled or twisted, it and the adjacent portions of hoses 10 and 12 are free to rotate, by means of coupling 20, with respect to the rest of hoses 10 and 12. When nozzle 14 is rotated, gasoline hose 10 will rotate about its own axis, end 26 will rotate about such axis with hose 10, and vapor hose 12 (top end 32 thereof) will rotate in an arc about hose 10. Thus a rotatable coupling for dual, paralleled hoses is provided which can preclude snarling kinking, or twisting of such hoses. Also any leakage of coupling 30 will be contained within enclosure 22, rather than released to the atmosphere.

While the above disclosure contains many specifications, these should not be construed as limitations of the scope of the invention, but rather as exemplifications, the true scope being indicated by the appended claims and their legal equivalents.

What is claimed is:

1. A rotatable dual hose arrangement for conveying two respective fluids independently, comprising:

a first tube comprising an elongated cylinder with walls which are relatively thin in relation to the bore of said tube and having a rotary coupling therein for enabling a first portion of said tube on one side of said coupling to be rotated with respect to a second portion of said tube on the other side of said coupling while enabling fluid to be conveyed in said tube without loss thereof, an enclosure box mounted about the portion of said first tube containing said rotary coupling, said enclosure box having relatively thin walls with respect to the inside dimensions of said box, said walls substantially completely surrounding said rotary coupling, said box, except for one wall thereof, being fixed to said second portion of said first tube, said one wall thereof comprising a circular member which is substantially flat, said one wall being fixed to said first portion of said first tube and being rotatably mounted with respect to said enclosure box and said second portion of said first tube, a second tube comprising an elongated cylinder having relatively thin walls with respect to the bore of said tube and comprising two separated portions, a first portion thereof communicating with and terminating into said enclosure box at a portion thereof other than said one wall thereof, a second portion thereof communicating with and terminating into said one wall of enclosure box at a location spaced from the place where said first portion of said first tube joins said one wall, whereby said first portion of said first tube and said second portion of said second tube can be rotated with respect to said second portion of said second tube and said first portion of said second tube while said first and second tubes can convey first and second fluids independently.

2. The arrangement of claim 1 wherein said enclosure box is substantially fluid tight around said first tube except for the connections of said second tube into said enclosure box.

3. The arrangement of claim 1 wherein said second portion of said first tube leads into a wall of said enclosure box opposite said one wall thereof.

4. The arrangement of claim 1 wherein said first portion of said first tube and said second portion of said second tube are terminated into a nozzle.

5. The arrangement of claim 4 wherein said nozzle includes a handle and valve for controlling fluid flow in at least one of said tubes.

* * * * *